US010309358B2

(12) United States Patent
Qin et al.

(10) Patent No.: US 10,309,358 B2
(45) Date of Patent: Jun. 4, 2019

(54) FUEL PRESSURE PULSATION DAMPING DEVICE AND FUEL SYSTEM INCLUDING THE SAME

(71) Applicant: Ford Global Technologies LLC, Dearborn, MI (US)

(72) Inventors: Charles Qin, Nanjing (CN); Le Hong, Nanjing (CN); Steven Shi, Nanjing (CN)

(73) Assignee: Ford Global Technologies LLC, Dearborn, MI (US)

( * ) Notice: Subject to any disclaimer, the term of this patent is extended or adjusted under 35 U.S.C. 154(b) by 0 days.

(21) Appl. No.: 15/809,841

(22) Filed: Nov. 10, 2017

(65) Prior Publication Data

US 2018/0135577 A1 May 17, 2018

(30) Foreign Application Priority Data

Nov. 15, 2016 (CN) ..... 2016 1 1025047

(51) Int. Cl.
*F02M 55/04* (2006.01)
*F02M 37/00* (2006.01)

(52) U.S. Cl.
CPC ..... *F02M 55/04* (2013.01); *F02M 37/0052* (2013.01); *F02M 2200/315* (2013.01)

(58) Field of Classification Search
CPC ..... F02M 55/04; F02M 37/0052; F02M 2200/315
See application file for complete search history.

(56) References Cited

U.S. PATENT DOCUMENTS

| | | | | |
|---|---|---|---|---|
| 2,210,480 | A * | 8/1940 | Brice | F16L 55/043 138/42 |
| 2,749,752 | A * | 6/1956 | Gehre | G01F 1/10 73/861.82 |
| 3,867,840 | A * | 2/1975 | Baatz | G01F 1/065 73/861.33 |
| 3,991,144 | A | 11/1976 | Diener | |
| 4,389,897 | A * | 6/1983 | Kolodziejski | G01F 1/72 73/114.53 |
| 4,864,815 | A * | 9/1989 | Cygnor | F02C 7/236 60/786 |
| 5,357,792 | A | 10/1994 | Getenby | |
| 6,901,964 | B2 | 6/2005 | Kippe et al. | |
| 6,948,479 | B1 | 9/2005 | Raney et al. | |
| 7,143,748 | B2 | 12/2006 | Zdroik et al. | |
| 7,789,071 | B2 | 9/2010 | Akita et al. | |
| 10,060,774 | B1 * | 8/2018 | Bartlett | G01F 15/00 |

FOREIGN PATENT DOCUMENTS

EP 1985837 10/2008

* cited by examiner

*Primary Examiner* — Joseph J Dallo
(74) *Attorney, Agent, or Firm* — Julia Voutyras; Kolitch Romano LLP

(57) ABSTRACT

The present disclosure provides a fuel pressure pulsation damping device in a fuel return line between a high pressure pump and a fuel tank in a fuel system. The fuel pressure pulsation damping device includes a housing having an inlet pipe, an outlet pipe and an intermediate pipe; and a rotatory impeller positioned in the intermediate pipe.

20 Claims, 4 Drawing Sheets

FUEL PRESSURE PULSATION DAMPING DEVICE AND FUEL SYSTEM INCLUDING THE SAME

RELATED APPLICATION

This application claims the benefit of Chinese Patent Application No.: CN 201611025047.9 filed on Nov. 15, 2016, the entire contents thereof being incorporated herein by reference.

FIELD

The present disclosure relates to a fuel pressure pulsation damping device and a fuel system including the same.

BACKGROUND

In a diesel engine, fuel is pressurized and supplied to a fuel rail via a high pressure pump and injected into a combustion chamber via a fuel injector. Under some circumstances, the high pressure pump is required to continuously provide fuel to the fuel rail in order to maintain a predetermined pressure in the fuel rail, and unused fuel will flow back into a fuel tank via a fuel return line from the high pressure pump. Operation of the high pressure pump may cause fuel pressure pulsation in the fuel return line, which may be excited to induce a vibration of the fuel line. In a vehicle with a diesel engine, a vibration of the fuel line may be transmitted into a vehicle body, thus causes a noise. A metallic pulsation damping box used in a conventional fuel line is expensive. Thus, there is a need for a simple and low cost fuel pressure pulsation damping device adapted for various fuel system.

SUMMARY

According to one aspect of the present disclosure, a fuel pressure pulsation damping device is provided. The damping device is located in fuel return line between a high pressure pump and fuel tank in a fuel system. The damping device includes a housing having an inlet pipe, an outlet pipe and an intermediate pipe; and a rotatory impeller positioned in the intermediate pipe.

In one embodiment, a cross-sectional area of the intermediate pipe is larger than a cross-sectional area of the inlet pipe and the outlet pipe.

In another embodiment, a radius of the intermediate pipe is three times of a radius of the inlet pipe.

In another embodiment, a length of the intermediate pipe is in arrange from about 12 mm to about 15 mm.

In another embodiment, the impeller includes a plurality of vanes having an angle relative to a cross-section of the intermediate pipe and spaced apart from each other.

In another embodiment, the angle of the vane relative to the cross-section of the intermediate pipe is in arrange of about ten degrees to about thirty degrees.

In another embodiment, a sum of an area of the plurality of vanes projecting on the cross-section of the intermediate pipe is about 60% to about 90% of a cross-sectional area of the intermediate pipe.

In another embodiment, the fuel pressure pulsation damping device further comprising a supporting structure integrally formed with the housing to support the plurality of vanes.

In another embodiment, the impeller further includes an annular portion surrounding the plurality of vanes and an outer surface of the annular portion of the impeller is spaced apart from an inner surface of the intermediate pipe.

In another embodiment, the supporting structure is positioned at the cross-section of the intermediate pipe, and the supporting structure is a cruciform structure.

In another embodiment, the impeller is connected to the supporting structure via a fastener.

In another embodiment, the housing includes a first housing and a second housing, and the first housing and the second housing together form the housing.

In another embodiment, the supporting structure includes a first supporting portion integrally formed with the first housing and a second supporting portion integrally formed with the second housing.

In another embodiment, the first housing and the second housing respectively form a first reinforcement rib and a second reinforcement rib adjacent to a rim thereof along a lengthwise direction and contact each other when the first housing is assembled to the second housing.

In another embodiment, the housing and the impeller are formed of plastic material.

According to another aspect of the present disclosure, a fuel supply system is provided. The fuel supply system includes a fuel tank; a high pressure pump; a supply line connecting with the fuel tank and the high pressure pump; a return line connecting with the fuel tank and the high pressure pump; and a fuel pressure pulsation damping device positioned at the return line between the high pressure pump and the fuel tank; wherein the fuel pressure pulsation damping device includes a housing having an inlet pipe, an outlet pipe and an intermediate pipe positioned between the inlet pipe and the outlet pipe; and a rotatory impeller positioned in the intermediate pipe, wherein a cross-section area of the intermediate pipe is larger than a cross-section area of the outlet pipe.

In one embodiment, the fuel pressure pulsation damping device is positioned closer to the high pressure pump than the fuel tank.

In another embodiment, the impeller includes a plurality of vanes having an angle relative to a cross-section of the intermediate pipe and spaced apart from each other.

In another embodiment, the angle of the vane relative to the cross-section of the intermediate pipe is between ten degrees and thirty degrees.

In another embodiment, the fuel supply system further comprises a supporting structure integrally formed with the housing to support the impeller.

In another embodiment, the impeller is connected to the supporting structure via a fastener.

In another embodiment, the housing includes a first housing and a second housing, and the first housing and the second housing together form the housing.

In another embodiment, the first housing and the second housing respectively form a first rib and a second rib adjacent to a rim thereof along a lengthwise direction and contact each other when the first housing is assembled to the second housing.

In another embodiment, the supporting structure includes a first supporting portion integrally formed with the first housing and a second supporting portion integrally formed with the second housing.

One or more advantageous features as described herein are believed to be readily apparent from the following detailed description of one or more embodiments when taken in connection with the accompanying drawings.

BRIEF DESCRIPTION OF DRAWINGS

Example embodiments will be more clearly understood from the following brief description taken in conjunction with the accompanying drawings. The accompanying drawings represent non-limiting, example embodiments as described herein.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element of feature.

DETAILED DESCRIPTION

The disclosed fuel pressure pulsation damping devices and fuel systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described, in the following detailed description.

Throughout the following detailed description, examples of various fuel pressure pulsation damping devices and fuel systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
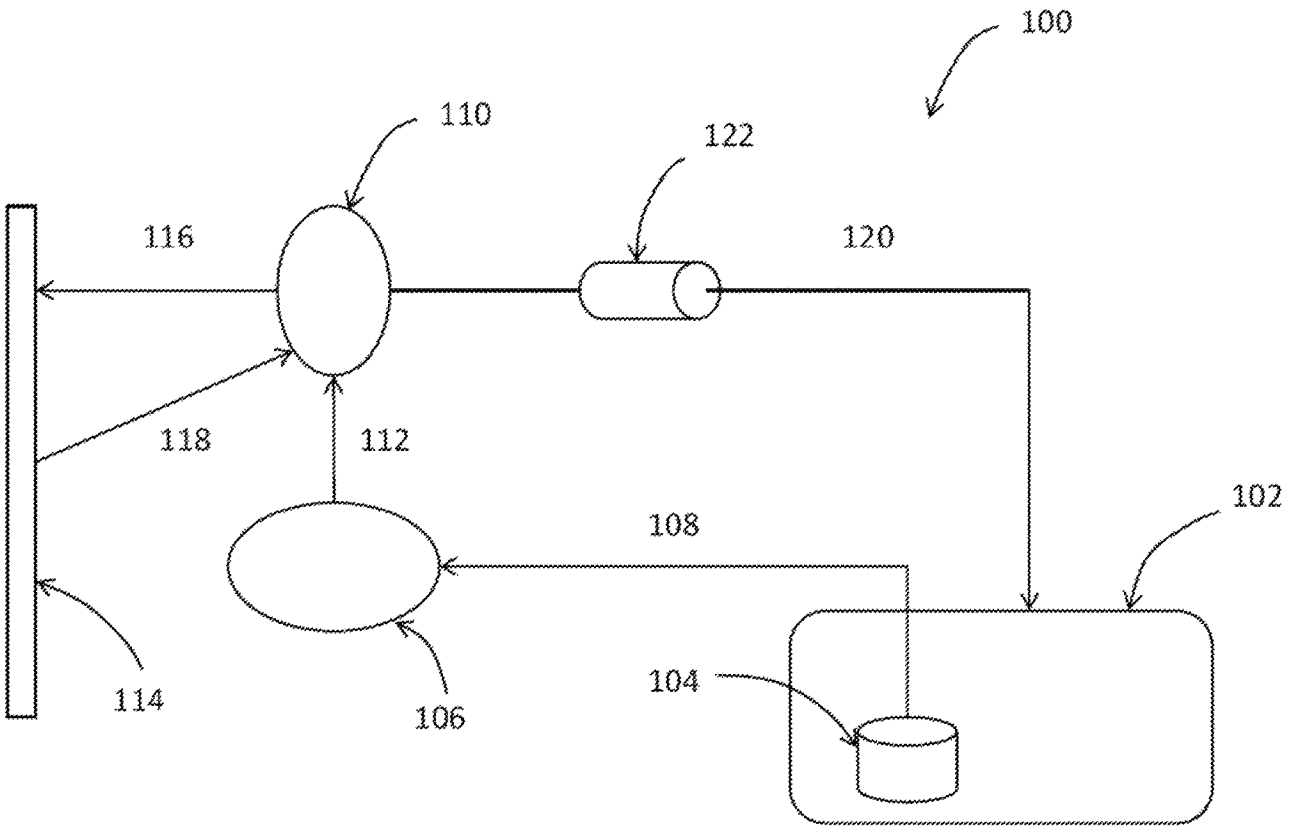
FIG. 1 is a schematic diagram of a fuel supply system according to one embodiment of the present disclosure.

FIG. 1 is a schematic diagram of a fuel supply system 100 according to one embodiment of the present disclosure. The fuel supply system 100 may be a fuel supply system of an engine in a vehicle. In one or more embodiments, the fuel supply system 100 may be a fuel supply system of a diesel engine. The fuel supply system 100 may include a fuel tank 102, a fuel pump 104 positioned in the fuel tank 102, a filter 106, a first supply line 108 connecting to the fuel pump 104 and the filter 106, a high pressure pump 110, a second supply line 112 connecting the filter 106 and the high pressure pump 110, a fuel rail 114, a third supply line 116 and a first return line 118 connecting to the high pressure pump 110 and the fuel rail 114, and a second return line 120 connecting to the high pressure 110 and the fuel tank 102. In some embodiments, the fuel supply system 100 may include a pressure pulsation damping device 122 positioned at the second return line 120. In one or more embodiments, the fuel pump 104 may be a low pressure pump and provide fuel to the high pressure pump 110 via the first supply line 108 and the second supply line 112. The fuel may be filtered by the filter 106 before entering into the high pressure 110. The filtered fuel may be pressurized and provided to the fuel rail 114 via the third supply line 116. In one or more embodiments, the high pressure pump 110 may be a piston pump. Under some circumstances, the high pressure pump 110 needs to operate continuously to supply fuel to fuel rail 114 in order to maintain a necessary pressure in the fuel rail 114. Extra fuel will flow back to the high pressure pump 110 via the first return line 118 and then flow back to the fuel tank 102 via the second return line 120 when a predetermined pressure is reached in the fuel rail 114. The operation of the high pressure pump may cause a pressure pulsation in the return line, which may result in a vibration of the fuel line relative to a vehicle body, thus a noise will be generated. A fuel pressure pulsation damping device 122 of the present disclosure is provided to damp noise caused by pressure pulsation. The fuel pressure pulsation damping device will be detailed in the following description.

Figure 2:
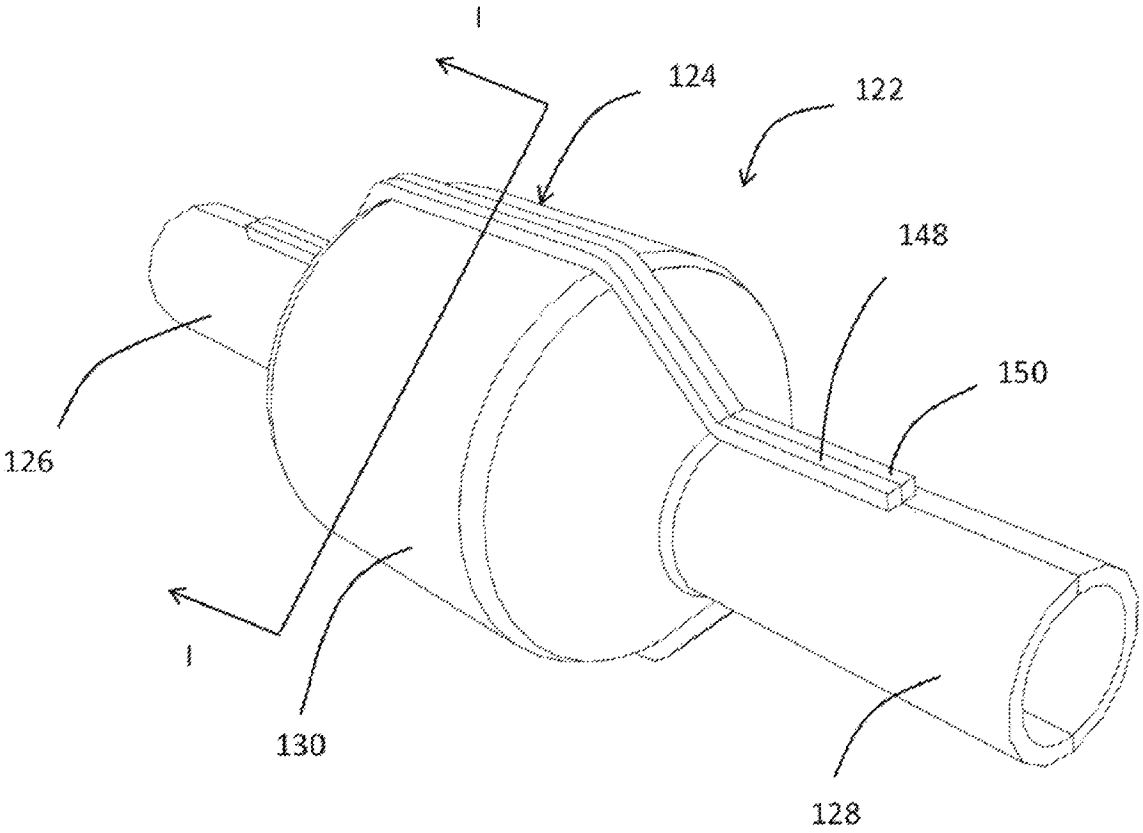
FIG. 2 is a perspective view of a fuel pressure pulsation damping device according to one embodiment of the present disclosure.
Figure 3:
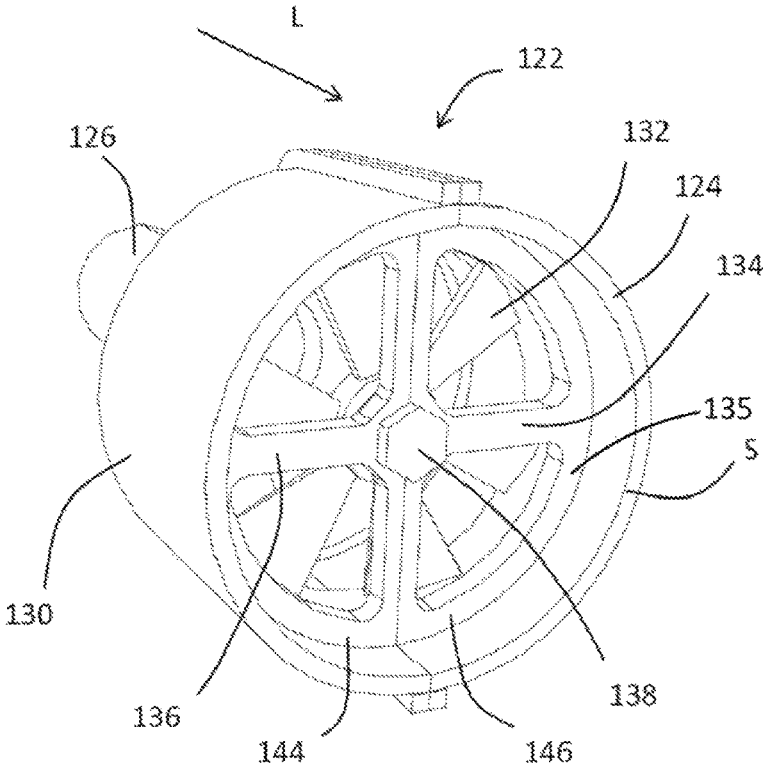
FIG. 3 is a perspective view of a part of the fuel pressure pulsation damping device along lines I-I in FIG. 2.

Referring to FIG. 2 and FIG. 3, FIG. 2 depicts a perspective view of the fuel pressure pulsation damping device 122 in FIG. 1. FIG. 3 depicts a perspective view of the fuel pressure pulsation damping device 122 from a cross section along line I-I. In one or more embodiments, the fuel pressure pulsation damping device 122 may include a housing 124 and a rotatory impeller 132 positioned in an intermediate pipe 130. The housing 124 includes an inlet pipe 126, an outlet pipe 128 and the intermediate pipe 130 positioned between the inlet pipe 126 and the outlet pipe 128. The inlet pipe 126 and the outlet pipe may be connected to the second return line 120 via any suitable methods. For example, the inlet pipe 126 and the outlet pipe 128 may have a thread portion to connect with the second return line 120 via a thread. In one or more embodiments, the fuel pressure pulsation damping device 122 further includes a supporting structure 134 to support the impeller 132. The supporting structure 134 is positioned at a cross-section of the intermediate pipe 130 or a plane substantially perpendicular to the length direction L. The supporting structure 134 may include an annular ring 134 and a plurality of ribs 136 extending from the annular ring and connecting each other at a center of the cross section. An assembling hole 152 is formed on a connection portion of the ribs 136 or a center of the cross section of the supporting structure 134. In an embodiment shown in FIG. 3, the supporting structure 134 has four ribs 136 passing through a diameter of a cross-section of the housing 124 and uniformly distributed along a circumferential direction, that is, the supporting structure 134 is a cruciform structure. It should be understood that the supporting structure 134 may also include three ribs 136 uniformly distributed along a circumferential direction. In one or more embodiments, the supporting structure 134 may be integrally formed with the housing 124. For example, the supporting structure 134 may be integrally formed with the housing 124 in an injection molding process. In other embodiment the supporting structure 134 may be connected to the housing 124 via a fastener. In one or more embodiments, the impeller 132 may assembled to the supporting structure 134 by a fastener 138 via the assembling hole 152.

Figures 4A, 4B:
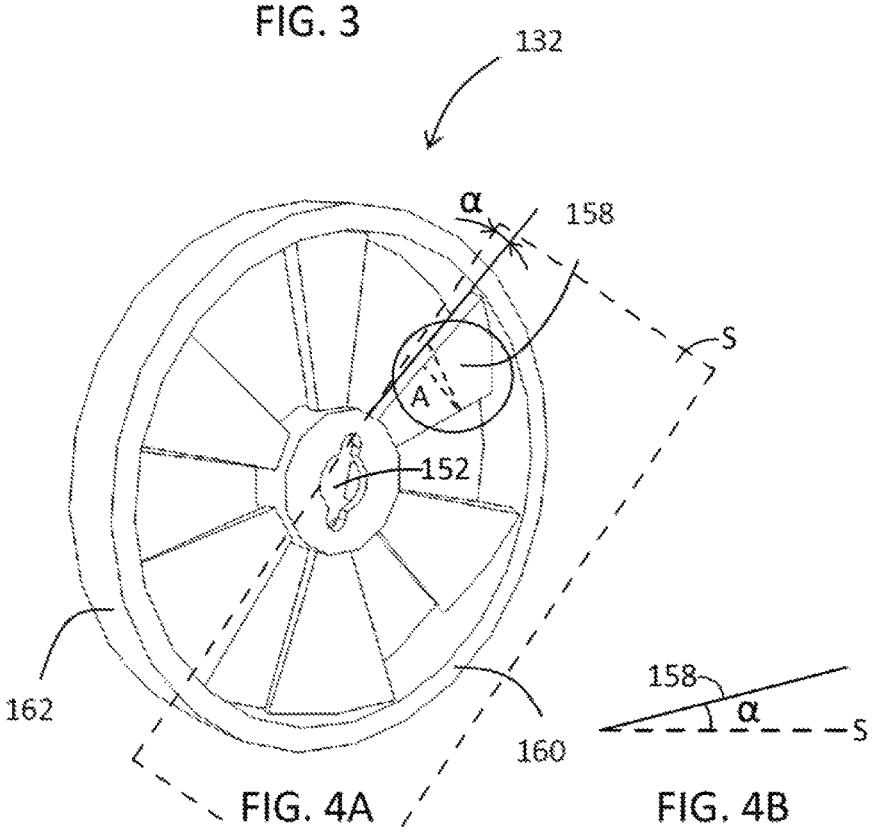
FIG. 4A is a perspective view of an impeller of the fuel pressure pulsation damping device in FIG. 3.
FIG. 4B depicts an enlarged view of a portion A of an impeller vane of the impeller in FIG. 4A.

FIG. 4A depicts an enlarged view of the impeller 132, and FIG. 4B depicts an enlarged portion A of a vane of the impeller 132. Referring to FIGS. 4A and 4B and with further reference to FIG. 3, the impeller 132 is positioned in the intermediate pipe 130. A diameter of the intermediate pipe 130 may be larger than a diameter of the inlet pipe 126 and a diameter of the outlet pipe 128. Because a volume of the intermediate pipe 130 is larger than a volume of the return line for a same length, thus a kinetic energy or pressure pulsation of fuel is reduced after fuel enters into the intermediate pipe 130.

The impeller 132 may further reduce pressure pulsation. The impeller 132 may include a plurality of vanes 158 and an annular portion 160 surrounding the plurality of vanes 158. Referring to FIGS. 4A and 4B, the vane 158 may has an angle $\alpha$ relative to a cross-section of the intermediate pipe 130 or relative to a plane S substantially perpendicular to the lengthwise direction and spaced apart from each other. In one or more embodiments, the vane 158 has a flat surface. In one or more embodiments, the angle $\alpha$ between the vane 158 and the cross-section S may be between ten degrees and thirty degrees. In one or more embodiments, a flow direction of fuel is the same as a length direction L and perpendicular to the cross-section S. The fuel entering into the intermediate pipe 130 impacts the vanes 158 and thus drives a rotation of the vanes 158. Pulsation energy of fuel is at least partially translated into rotatory energy of the impeller 132 and the turbulence flow. Thus, noise resulted from fuel pressure pulsation may be effectively reduced.

The shape and the size of the impeller 158 may be configured to reduce pulsation of a specific fuel system. For example, the impeller 158 may have a curved surface or a flat surface. In one or more embodiments, an outer surface 162 of the annular portion 160 of the impeller 112 may be spaced at a range between 1 mm and 2 mm from an inner surface of the intermediate pipe 130. In one or more embodiments, a sum of an area of the plurality of vanes 158 projecting on the cross-section S of the intermediate pipe 130 may account for 60% to 90% of a cross-sectional area of the intermediate pipe 130. In one or more embodiments, a thickness of the vanes 158 is at a range between 15 mm and 2.5 mm. In one or more embodiments, the vanes 158 and the impeller 132 may be formed from plastic material.

The material of the vanes 158 may be selected to facilitate the reduction of the pulsation of specific fuel system. For example, the vanes 158 may be made from a plastic material with different stiffness. In one car more embodiments, the vanes 158 may be made from a plastic material which is difficult to be deformed. In one or more embodiments, the vane 158 may be formed of a deformable plastic material or the thickness of the vane 158 may be relative small. The vanes may be vibrated by the fuel pressure pulsation to damp the pulsation while the vibration will not cause the vibration of the vehicle body. Deformation of the vanes 158 can be controlled at a desired range by the support from the annular portion 160 of the impeller.

In one or more embodiments, the impeller 132 may be positioned at a cross-section of the intermediate pipe 130 adjacent to the inlet pipe 126, or a cross-section positioned at the middle of the intermediate pipe 130, or a cross-section of the intermediate pipe 130 adjacent to the outlet pipe 128. The position of the impeller 132 in the intermediate pipe 130 may affect a pulsation energy conversion of the fuel entering into the intermediate pipe 130. Thus, the position of the impeller 132 in the intermediate pipe 130 may be varied based on specific fuel system.

In one or more embodiments, the fuel pressure pulsation damping device 122 is positioned closer to the high pressure pump 110 than the fuel tank 102 such that the fuel pressure pulsation would be damped in advance to prevent relative high pressure pulsation from being excited in the return line 120.

Figure 5:
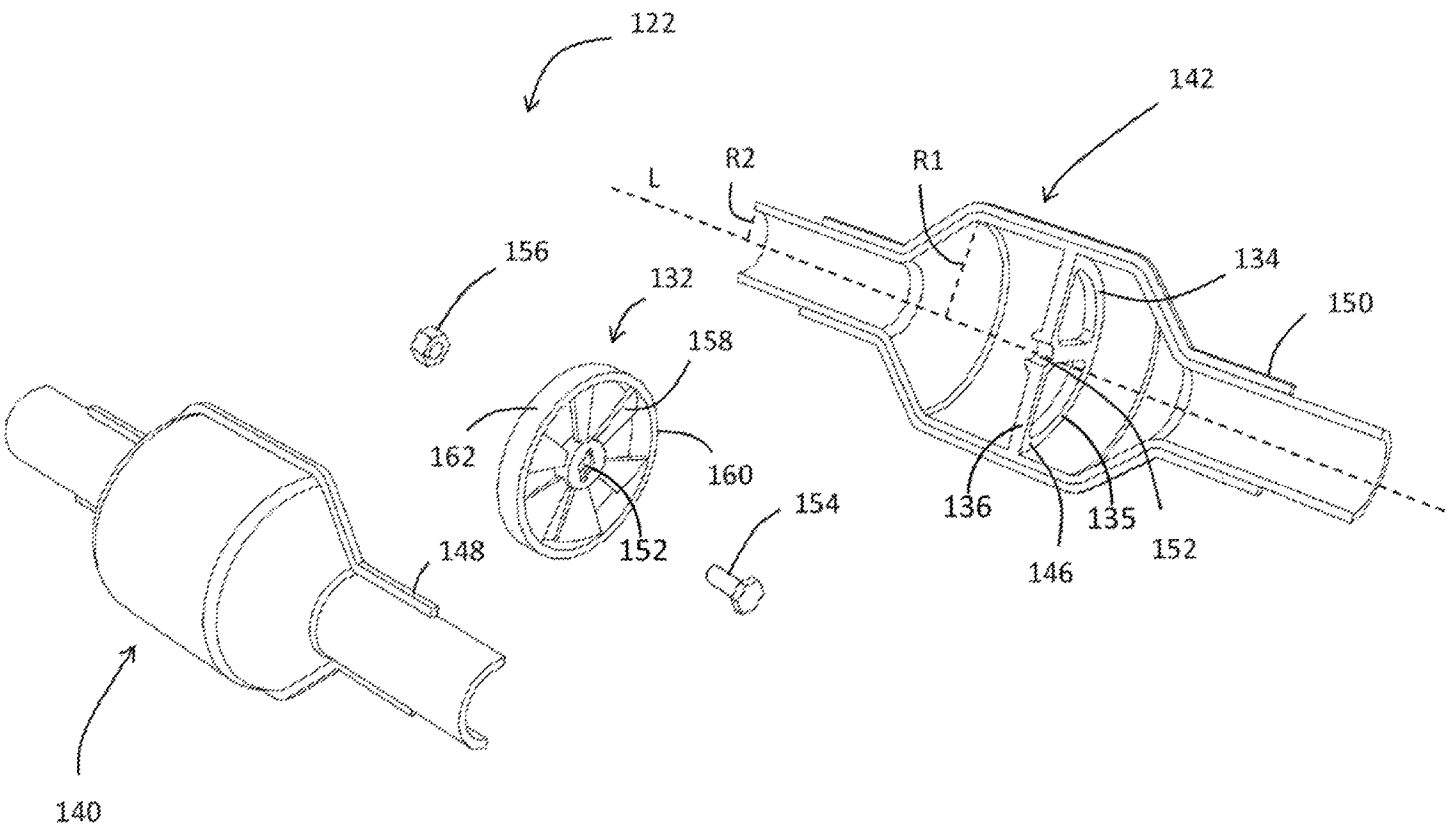
FIG. 5 depicts an exploded view of the fuel pressure pulsation damping device in FIG. 2.

Referring to FIG. 5 and FIG. 3, FIG. 5 depicts an exploded view of the fuel pressure pulsation damping device 122. The housing 124 includes a first housing half 140 and a second housing half 142, The first housing half 140 and the second housing half 142 extend at a lengthwise direction and opposite each other at the lengthwise direction. A cross-sectional area of the intermediate pipe 130 is larger than a cross-sectional area of the inlet pipe 126 and the outlet pipe 128. Further, a radius R1 of the intermediate pipe 130 is three times of a radius R2 of the inlet pipe 126. Such configuration may reduce fuel pressure pulsation through an expansion of the high pressure fuel when the fuel entering into the intermediate pipe 130 via the inlet pipe 126. In one or more embodiments, a length of the intermediate pipe 130 is about 40 mm, and the radius R1 is about 12 mm-15 mm. The first housing half 140 may be connected to the second housing half 142 via any appropriate methods such as an adhesive, a fastener or welding etc. In one or more embodiments, the supporting structure 134 includes a first supporting portion 144 integrally formed with the first housing half 140 and a second supporting portion 146 integrally formed with the second housing half 142. The first housing half 140 and the second housing half 142 include a first reinforcement rib 148 and a second reinforcement rib 150 adjacent to a rim thereof along a length direction L respectively, which may contact each other when the first housing half 140 is assembled to the second housing half 142. Further, the supporting structure 134 includes a mounting hole 152 to receive a fastener for example a stud 154 and a nut 156 to assemble the impeller 132 to the supporting structure 134. In one or more embodiments, the housing 124 is formed from plastic material in an injection molding process.

It should be understood that the housing may be formed via other processes. For example, the housing may be blow-molded and divided into the first housing half and the second housing half at a cross-section. The first housing half may be connected to the second housing half via bonding, a fastener or welding after the impeller and the supporting structure are assembled to the first housing or the second housing.

In one or more embodiments, the housing and the impeller may be formed of plastic material. Accordingly, the fuel pressure pulsation damping device of the present disclosure has a simple structure and low cost. Further, the impeller may be designed to achieve a desired NVH level based on a specific fuel system.

The disclosure above encompasses multiple distinct inventions with independent utility. Which each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions.

The following claims particularly point out certain combinations and subcombinations regarded as novel and non-obvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

The invention claimed is:

1. A fuel pressure pulsation damping device located in a fuel return line between a high pressure pump and fuel tank in a fuel system, comprising:

a housing having an inlet pipe, an outlet pipe and an intermediate pipe; and a rotatory impeller positioned in the intermediate pipe and having a plurality of vanes, wherein the housing and the plurality of vanes are configured to reduce pulsation and wherein the housing is made of plastic material.

2. The fuel pressure pulsation damping device of the claim 1, wherein a cross-sectional area of the intermediate pipe is larger than a cross-sectional area of the inlet pipe and the outlet pipe.

3. The fuel pressure pulsation damping device of the claim 1, wherein a radius of the intermediate pipe is three times of a radius of the inlet pipe.

4. The fuel pressure pulsation damping device of the claim 1, wherein a length of the intermediate pipe is in a range of from about 12 mm and to about 15 mm.

5. The fuel pressure pulsation damping device of the claim 1, wherein each of the plurality of vanes of the impeller has an angle relative to a cross-section of the intermediate pipe and is spaced apart from each other, and wherein the impeller is made from plastic material and the plurality of vanes are deformable.

6. The fuel pressure pulsation damping device of the claim 5, wherein the angle of the vane relative to the cross-section of the intermediate pipe is in a range from about ten degrees to about thirty degrees.

7. The fuel pressure pulsation damping device of the claim 5, wherein a sum of an area of the plurality of vanes projecting on the cross-section of the intermediate pipe is about 60% to about 90% of a cross-sectional area of the intermediate pipe.

8. The fuel pressure pulsation damping device of the claim 5, further comprising a supporting structure integrally formed with the housing and connected to the impeller.

9. The fuel pressure pulsation damping device of claim 8, wherein the impeller further includes an annular portion surrounding the plurality of vanes and an outer surface of the annular portion of the impeller is spaced apart from an inner surface of the intermediate pipe.

10. The fuel pressure pulsation damping device of the claim 8, wherein the supporting structure is positioned at the cross-section of the intermediate pipe, and the supporting structure includes an annular ring and a plurality of ribs extending from the annular ring at a radial direction and connecting each other at a center of the cross section.

11. The fuel pressure pulsation damping device of the claim 10, wherein the impeller is connected to the supporting structure by a fastener via an assembling hole formed on a connection portion of the plurality of ribs of the supporting structure.

12. The fuel pressure pulsation damping device of the claim 8, wherein the housing includes a first housing half and a second housing half extending along a lengthwise direction and facing each other at the lengthwise direction, and the first housing half and the second housing half together form the housing.

13. The fuel pressure pulsation damping device of the claim 12, wherein the supporting structure includes a first supporting portion integrally formed with the first housing half and a second supporting portion integrally formed with the second housing half.

14. The fuel pressure pulsation damping device of the claim 13, wherein the first housing half and the second housing half include a first reinforcement rib and a second reinforcement rib adjacent to a rim along the lengthwise direction, respectively, and the first reinforcement rib and the second reinforcement rib contact each other when the first housing half is assembled to the second housing half.

15. The fuel pressure pulsation damping device of the claim 14, wherein the housing is made from plastic material, wherein the first housing half and the second housing half are made from plastic material in an injection molding process and assembled together to form the housing.

16. A fuel supply system, comprising:

a fuel tank;

a high pressure pump;

a supply line connecting the fuel tank and the high pressure pump;

a return line connecting the fuel tank and the high pressure pump; and a fuel pressure pulsation damping device positioned at the return line between the high pressure pump and the fuel tank;

wherein the fuel pressure pulsation damping device includes a housing having an inlet pipe, an outlet pipe and an intermediate pipe positioned between the inlet pipe and the outlet pipe; and a rotatory impeller positioned in the intermediate pipe, wherein the impeller includes a plurality of vanes, wherein a cross-section area of the intermediate pipe is larger than a cross-section area of the outlet pipe, and larger than a cross-section area of the inlet pipe, and wherein the housing and the plurality of vanes are configured to reduce pulsation and the housing is made of plastic material.

17. The fuel supply system of the claim 16, wherein the fuel pressure pulsation damping device is positioned closer to the high pressure pump than the fuel tank.

18. The fuel supply system of the claim 16, wherein the plurality of vanes have an angle relative to a cross-section of the intermediate pipe and spaced apart from each other.

19. The fuel supply system of the claim 16, further comprising a supporting structure integrally formed with the housing to support the impeller.

20. The fuel supply system of the claim 19, wherein the impeller is connected to the supporting structure via a fastener.

* * * * *